United States Patent [19]

Hayes

[11] Patent Number: 4,787,232

[45] Date of Patent: Nov. 29, 1988

[54] ROLL FORMING MEMBER AND/OR A ROLL FORMER

[75] Inventor: Thomas C. Hayes, Rotorua, New Zealand

[73] Assignee: Hayes Engineering Limited, Rotorua, New Zealand

[21] Appl. No.: 36,396

[22] Filed: Apr. 9, 1987

[30] Foreign Application Priority Data

Apr. 9, 1986 [NL] Netherlands ..... 215754

[51] Int. Cl.[4] ..... B21D 5/08

[52] U.S. Cl. ..... 72/176; 72/181; 72/182; 72/226

[58] Field of Search ..... 72/176, 181, 182, 178, 72/226; 493/442, 443, 454, 461

[56] References Cited

U.S. PATENT DOCUMENTS

| | | | |
|---|---|---|---|
| 2,023,913 | 12/1935 | Carroll | 72/182 |
| 3,796,081 | 3/1974 | Boardman | 72/226 |
| 4,142,393 | 3/1979 | Nagel | 72/181 |
| 4,656,858 | 4/1987 | Addison | 72/176 |

FOREIGN PATENT DOCUMENTS

| | | | |
|---|---|---|---|
| 749721 | 12/1944 | Fed. Rep. of Germany | 72/178 |
| 27723 | 2/1984 | Japan | 72/181 |
| 912319 | 3/1982 | U.S.S.R. | 72/178 |
| 984558 | 12/1982 | U.S.S.R. | 72/181 |
| 3336750 | 8/1930 | United Kingdom . | |
| 1085675 | 10/1966 | United Kingdom . | |
| 1180621 | 4/1970 | United Kingdom . | |
| 1255740 | 12/1971 | United Kingdom . | |
| 1353813 | 5/1974 | United Kingdom . | |
| 1392388 | 4/1975 | United Kingdom . | |
| 1470481 | 4/1977 | United Kingdom . | |
| 2141954 | 1/1985 | United Kingdom . | |

*Primary Examiner*—Daniel C. Crane

*Attorney, Agent, or Firm*—Holman & Stern

[57] ABSTRACT

A roll former comprises a bed and at least one roll forming member mounted on the bed, each roll forming member comprising a stand, a support member pivotally mounted on the stand for rotation relative to the stand about a selected axis, a pair of shaping elements mounted on the support member shaped to modify the shape of a member such as a purlin passed in use therebetween, and locating means to locate the support member in a selected one of a plurality of available positions relative to the stand.

15 Claims, 4 Drawing Sheets

ROLL FORMING MEMBER AND/OR A ROLL FORMER

BACKGROUND OF THE INVENTION

1. Field of the Invention

This invention relates to a roll forming member and/or a roll former.

2. Description of the Prior Art

With known constructions of roll formers it is necessary to remove the roll forming shaping elements and to replace them in the new position. In large roll formers forming for example purlins it can take between one half and a full day to convert the roll former from a roll former which forms a substantially squared c-shaped purlin to one that forms a substantially squared z-shaped purlin and vice versa. Such a lengthy down time is disadvantageous.

BRIEF SUMMARY OF THE INVENTION

It is an object of the present invention to provide a roll forming member and/or a roll former which will minimize the foregoing disadvantages.

Accordingly in one aspect the invention consists in a roll forming member comprising a stand, a support member, pivot means between said support member and said stand so that said support member is rotatable about a selected axis, a pair of shaping elements mounted on the support member shaped to in use modify the shape of a member passed therebetween, and locating means to locate the support member in a selected one of a plurality of positions relative to the stand.

In a further aspect the invention consists in a roll former comprising a bed and at least one roll forming member mounted on the bed, each roll forming member comprising a stand, a support member, pivot means between the support member and stand allowing rotation of the support member relative to the stand about a selected axis, a pair of shaping elements mounted on the support member shaped to in use modify the shape of a member passed therebetween, and locating means to locate the support member in a selected one of a plurality of positions relative to the stand.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings wherein.

DETAILED DESCRIPTION

Figure 2:
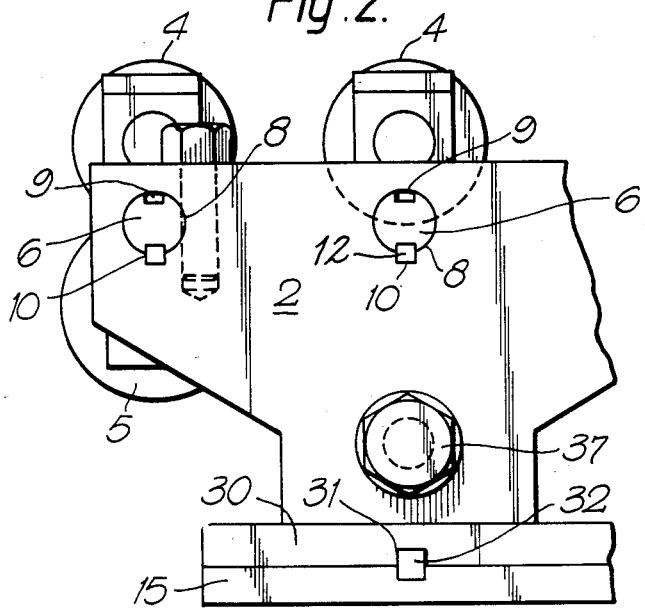
FIG. 2 is a right side elevational view of part of the construction of FIG. 1.

In the preferred form of the invention a roll forming member and a roll former include a roll forming member 1 which comprises a stand 2 and a support 3. The support 3 carries a pair of shaping elements, for example a shaping element 4 and a shaping element 5. Pivot means are provided between the support member 3 and the stand 2 to allow the support member to rotate about a selected axis and the pivot means may comprise a pivot pin such as a rod or axle 6 extending outwardly from the support member 3 and passing into an aperture 8 in the stand 2. The stand 2 may include a plurality of apertures 8 as can be seen from FIG. 2. The shaping members 4 and 5 comprise shaping rolls according to those presently known for roll forming thin sheet material, such as, thin sheet metal for example. Locating means are provided to locate the support member 3 in one of a plurality of available positions relative to the stand 2. Desirably two such positions are provided so that the positions of the shaping members 4 and 5 can be reversed. Thus, the shape formed by the particular roll forming member can be inverted relative to the sheet being shaped. The locating means may comprise a pair of grooves 9 on the pivot pin 6 which are shaped oppositely that is to say 180° apart. A further groove 10 is providing in the members defining the aperture 8 and a key 12 is insertable into the aperture formed by the groove 10 and a selected one of the apertures 9.

Figure 1:
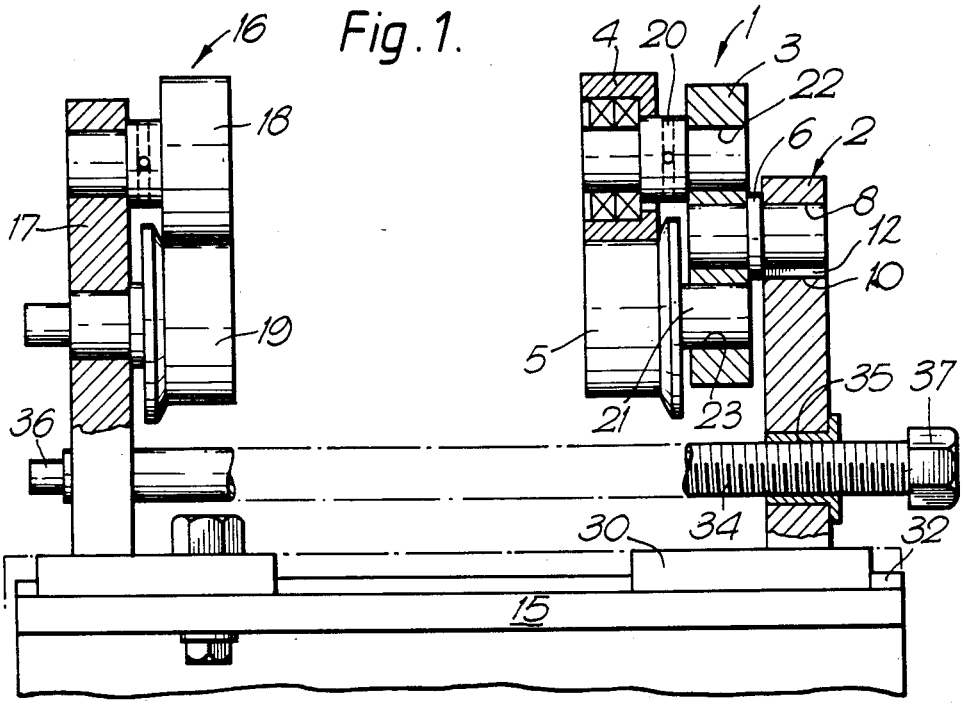
FIG. 1 is a end view of a pair of roll forming members on a bed according to one form of the invention, certain parts being shown in cross section.

The roll forming member 1 is mounted on a bed 15 which forms part of the roll former. The roll forming members are desirably provided in pairs and in the construction of FIG. 1 a roll forming member 1 is described which forms a pair with a further roll forming member 16 which does not have the invertable feature. Of course, if desired the roll forming member 16 could be provided with this feature. Thus the roll forming member described can be used for example to form purlins of what might be referred to as a squared c-shape or purlins of a squared z-shape by inverting the roll forming members down one side of the roll former. The roll forming member 16 in FIG. 1 simply comprises a stand 17 with an upper roll forming roll shaping member 18 and a lower shaping member 19 each mounted to the stand 17 by a suitable axle or pivot. The shaping members 4 and 5 are mounted to the support member 3 by axles 20 and 21 respectively passing into the apertures 22 and 23 in the support member 3.

It is desirable that at least one of the roll forming members in a pair is movable relative to the other and this may be achieved for example by providing a mechanism to allow for example the roll forming member 1 to be moved in a direction transverse to the usual direction of work flow through the roll former. One method of doing this is to provide the stand 2 on a foot 30 having a groove 31 therein into which a runner 32 mounted on the bed 15 is positionable.

To enable the inward or outward movement to occur a threaded rod 34 may be provided which engages threads at 35 in an aperture in the stand 2. The outer end 36 of the rod passes through an aperture in the stand 17, end 36 being unthreaded so that it will rotate therein. Therefore, by rotating the rod 34, for example by turning head 37, the stand 2 will be caused to move along runner 32.

Figure 3:
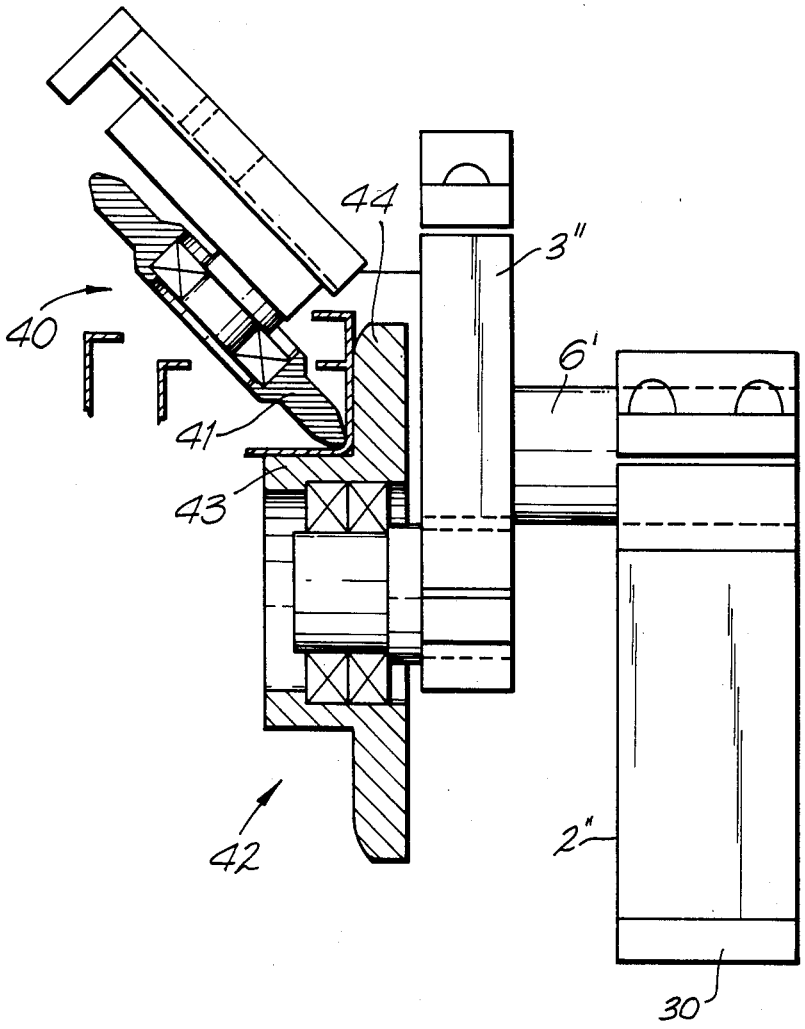
FIG. 3 is a partly cross-sectional end view of a roll forming member according to a further embodiment of the invention useable for squaring substantially right angle bends in a roll formed thin sheet of metal for example.

A similar construction is shown in FIG. 3 where a stand 2'' is provided with a pivot pin 6''. In this construction the upper shaping element 40 provides a wheel 41 whereas the lower shaping element 42 provides a member having a modified cylindrical part 43 and a flange 44. The perimeter of the wheel 41 enters the rebate formed by the part 43 and flange 44 so as to square up a right angle bend. The position of the upper and lower shaping members is able to be reversed in substantially the same manner as described for the construction in FIG. 1.

Figure 4:
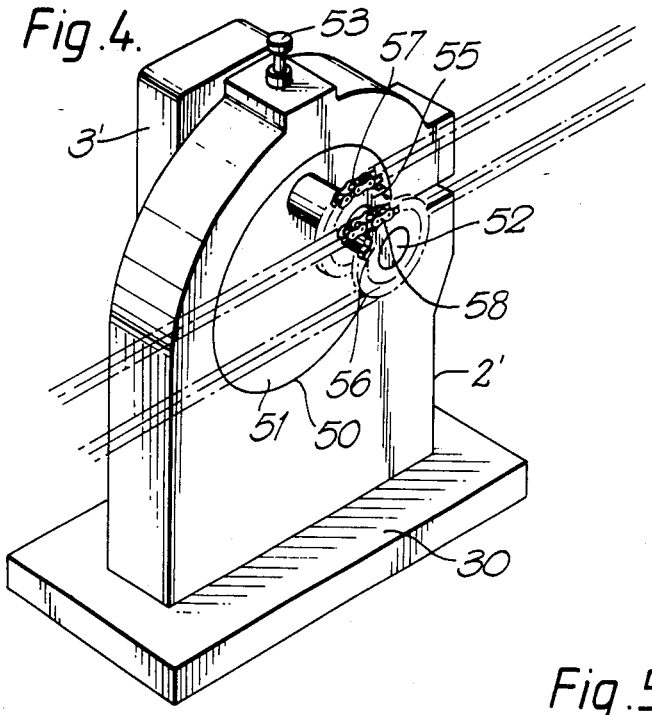
FIG. 4 is a diagrammatic perspective view of an alternative roll forming member according to the invention.
Figure 5:
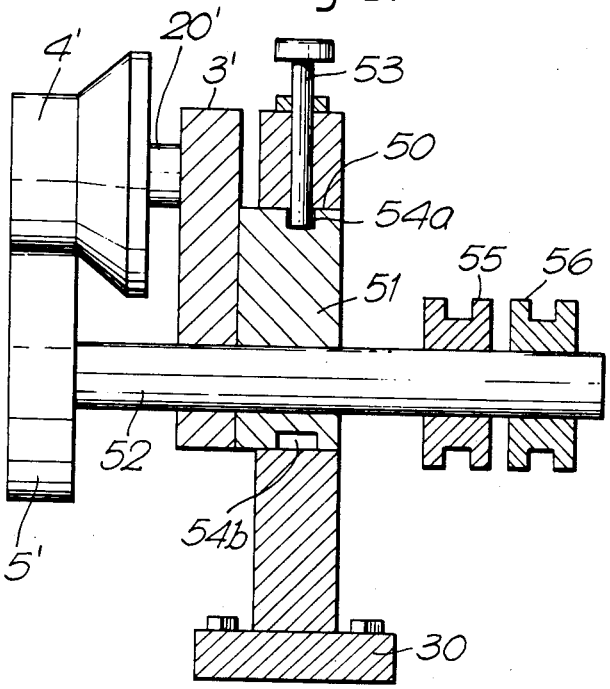
FIG. 5 is a diagrammatic cross-sectional view of the construction of FIG. 4.
Figure 6:
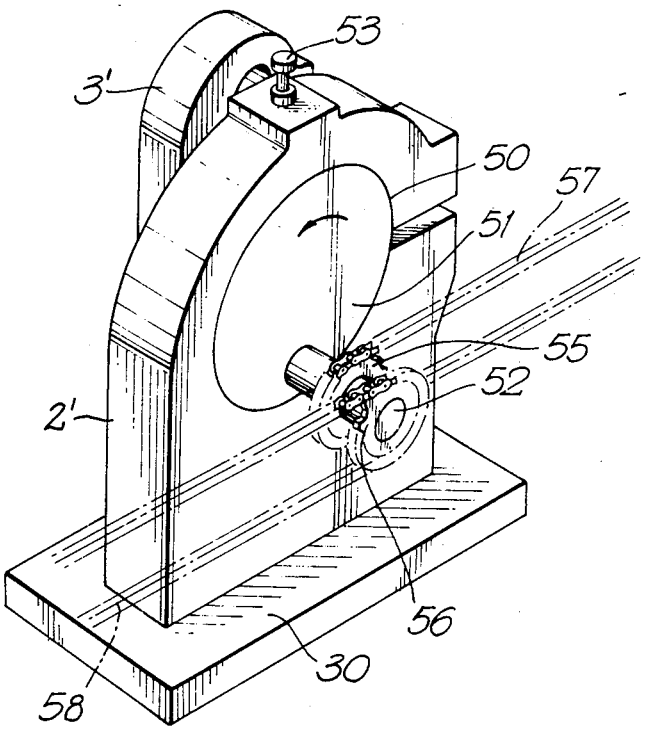
FIG. 6 is a view similar to FIG. 4 showing an alternative disposition of parts.

A modified construction is shown in FIGS. 4 to 6. In this embodiment, foot 30 mounts a stand 2' as before, but aperture 8 is replaced by a larger aperture 50 into which is positioned a larger pivot pin 51 extending from the support member 3'. Shaping element 4' is rotatably mounted on the support member 3' by axle 20' as before. The other shaping element 5' is mounted by axle 52 which passes through the member 3' and also the pivot pin 50. The axle 52 is not centrally located but offset as can be seen from FIGS. 4 to 6.

The location means may comprise a pin 53 passing into stand 2' to engage one of a pair of oppositely positioned depressions 54*a* and 54*b*. Lifting pin 53 therefore allows rotation of pivot pin 51 to allow reversal of the position of the rolls 4 and 5. A pair of pulleys, or cogs, 55 and 56 are provided on axle 52 and this allows interconnection of the axles 52 of a succession of stands 2' to allow direct driving of the rolls 5' by belts or chains such as chains 57 and 58.

The use of the invention will now be described.

In use the roll former is set up so that the desired upper and lower shaping members 4 and 5 are in the desired position to form the construction required. Thus, for example, the upper shaping members 4 may be positioned uppermost or lowermost depending on whether the edge is to be turned upwardly or downwardly respectively. In order to change for example an upward turned edge to a downward turned edge the key 12 in grooves 9 and 10 is removed and the position of the shaping members 4 and 5 is reversed. The key 12 is then re-inserted in the groove 10 and the opposite groove 9. The alternative construction can then be made.

The construction of FIGS. 4 to 6 operates similarly and the succession of members 3' can be rotated by turning the first pivot pin 51 with which no chain 57 is engaged, or has been relaxed, through 90° in the direction of the arrow shown in FIG. 6 and then the following pivot pins 51 are rotated. The first pivot pin 51 is then rotated through a further 90° to complete the reversal of position of rolls 4 and 5. The remaining pivot pins 51 are then rotated in sequence again. Pin 53 is first lifted to allow the rotation to be performed.

Thus it can be seen that at least in the preferred form of the invention a roll forming member and/or a roll former are provided which has the advantage that the setting up time of the roll former over known constructions where it is necessary to remove the roll forming shaping elements and to replace them in the new position is substantially reduced. In large roll formers, forming for example purlins, at present it can take between one half and a full day to convert the roll former from a roll former which forms a substantially squared c-shaped purlin to one that forms a substantially squared z-shaped purlin and vice versa. It is believed that a roll former incorporating the present invention can be changed in about 10 minutes or less by a competent operator, but this time could be extended to about half an hour if it is desired to also change the size of the purlin, that is to say to move the whole roll forming member rather than just invert the shaping members.

What is claimed is:

1. A roll forming member for shaping thin sheet material fed in a feeding direction relative to the roll forming member comprising:

a stand;

a support member;

pivot means for mounting said support member on said stand so that said support member is rotatable relative to said stand about a selected axis extending at substantially right angles to the feeding direction;

a pair of shaping elements mounted on substantially parallel axes on said support member and positioned with respect to each other so that in use each shaping element bears on one of the opposite surfaces of the sheet material, said shaping elements being shaped to modify the shape of the sheet material when passed therebetween said parallel axes of said shaping elements being parallel to said selected axis; and locating means for retaining said support member in a selected one of a plurality of positions relative to said stand and said selected axis so that the support member can be pivoted to permit each shaping element to bear against either side of the sheet material.

2. A roll forming member as claimed in claim 1, wherein:

said locating means retains said support member in two selected positions relative to said stand displaced 180° about said selected axis.

3. A roll forming member as claimed in claim 1 wherein said pivot means comprises:

a pivot pin extending from said support member; and an aperture in said stand in which said pivot pin is received.

4. A roll former through which thin sheet material passes in a first direction comprising:

a bed; and at least one roll forming member mounted on said bed comprising:

a stand, a support member, pivot means for mounting said support member on said stand so that said support member is rotatable relative to said stand about a selected axis extending in a second direction substantially at right angles to said first direction, a pair of shaping elements mounted on substantially parallel axes on said support member and positioned with respect to each other so that in use each shaping element bears on one of the surfaces of the sheet material, said shaping elements being shaped to modify the shape of the sheet material when passed therebetween, said parallel axes of said shaping elements being parallel to said selected axis and locating means for retaining said support member in a selected one of a plurality of positions relative to said stand and said selected axis so that the support member can be pivoted to permit each shaping element to bear against either side of the sheet material.

5. A roll former as claimed in claim 4 wherein two selected positions between said support member and said stand are available said selected positions being displaced 180° from the other.

6. A roll former as claimed in claim 4 wherein said pivot means comprises a pivot pin extending from said support member and an aperture in said stand into which said pivot pin is positioned.

7. A roll former as claimed in claim 4 wherein a plurality of roll forming members are mounted on said bed, said roll forming members being provided as at least one pair of spaced apart roll forming members.

8. A roll former as claimed in claim 7 wherein at least one of said roll forming members in a pair is movable towards or away from the other said roll forming member in said pair.

9. A roll forming member as claimed in claim 1 wherein:

said pair of shaping elements comprises a pair of forming rollers rotatably mounted on said support member on axes radially spaced from said selected axis so that rotation of said support member into each one of said plurality of positions modifies the relative postions of said forming rollers with respect to said stand and said selected axis.

10. A roll forming means as claimed in claim 9, wherein:

said locating means retains said support member in two selected positions relative to said stand displaced 180° about said selected axis.

11. A roll forming member as claimed in claim 9 wherein:

said forming roller axes are positioned at 180° with respect to each other about said selected axis so that when said support member is rotated from one of said selected positions to another of said selected positions, said forming rollers are reversed in position with respect to said stand.

12. A roll forming member as claimed in claim 3 wherein said locating means comprises:

a plurality of circumferentially spaced key slots in said pivot pin;

a key slot in said stand in the surface of said aperture; and a key engagable in said key slots when said key slots are in alignment.

13. A roll forming member as claimed in claim 4, wherein: said pair of shaping elements comprises a pair of forming rollers rotatably mounted on said support member on axes radially spaced from said selected axis so that rotation of said support member into each one of said plurality of positions modifies the relative positions of said forming rollers with respect to said stand and said selected axis.

14. A roll forming member as claimed in claim 13, wherein:

said forming roller axes are positioned at 180° with respect to each other about said selected axis so that when said support member is rotated from one of said selected positions to another of said selected positions, said forming rollers are reversed in position with respect to said stand.

15. A roll forming member as claimed in claim 6, wherein said locating means comprises:

a plurality of circumferentially spaced key slots in said pivot pin;

a key slot in said stand in the surface of said aperture; and a key engagable in said key slots when said key slots are in alignment.

* * * * *